US005172909A

United States Patent [19]

Ricciardi

[11] Patent Number: 5,172,909

[45] Date of Patent: Dec. 22, 1992

[54] SECONDARY PIVOTAL DRIVE STACKER ROLLER ENABLING STACKING OF SMALL AND LARGE DOCUMENTS

[75] Inventor: Mario Ricciardi, Glenview, Ill.

[73] Assignee: Bell & Howell Company, Skokie, Ill.

[21] Appl. No.: 802,049

[22] Filed: Dec. 3, 1991

[51] Int. Cl.[5] ..... B65H 39/10; B65H 43/00

[52] U.S. Cl. ..... 271/305; 271/176; 271/179

[58] Field of Search ..... 271/176, 179, 199, 208, 271/207, 265, 302, 300, 303, 305; 209/552, 553

[56] References Cited

U.S. PATENT DOCUMENTS

| | | | |
|---|---|---|---|
| 3,724,657 | 4/1973 | Katagiri et al. | 271/302 |
| 3,955,812 | 5/1976 | Suda et al. | 271/265 |
| 4,541,624 | 9/1985 | Sasage et al. | 271/265 |
| 4,875,670 | 10/1989 | Petersen et al. | 271/265 |

*Primary Examiner*—D. Glenn Dayoan

*Assistant Examiner*—Steven M. Reiss

*Attorney, Agent, or Firm*—Welsh & Katz, Ltd.

[57] ABSTRACT

A secondary pivotal drive stacker roller assembly for a document sorting and conveying apparatus adapted for sorting documents of various lengths, preferably from a primary document path to at least one secondary document path leading to a document stacking station, the roller assembly including a roller oriented for rotation about a vertical axis and for engaging shorter length documents advanced along the secondary document path, a pivot arm for reciprocally pivoting the roller into and out of engagement with documents advanced along the secondary document path, and a control system for controlling the pivot arm to selectively position the roller for engaging the shorter length documents, and to disengage the roller from the secondary document path when longer length documents are to be sorted.

19 Claims, 2 Drawing Sheets

SECONDARY PIVOTAL DRIVE STACKER ROLLER ENABLING STACKING OF SMALL AND LARGE DOCUMENTS

BACKGROUND OF THE INVENTION

The present invention relates generally to belt type conveyor systems for sorting and conveying flat documents on-edge and equipped with diverter mechanisms for diverting documents from a primary document path to one of at least two secondary document paths, and more particularly to a secondary pivotal drive stacker roller for use with such a sorting conveyor system to facilitate the advancement of shorter length documents along each secondary document path towards a stacker station.

Conveying systems are generally known which convey and sort documents, such as mailing envelopes and the like, on-edge along a primary or main path from which the documents may be selectively diverted or sorted according to predetermined criteria such as their particular mailing zone destination. The primary conveyor paths of such systems are generally defined at least in part by a rectilinear, vertically disposed run of a primary endless conveyor belt.

One or more document diverter or sorter stations are supported along the length of the primary conveyor belt, and each includes a secondary conveyor belt having a run inclined to the primary conveyor path, and along which a document travels when diverted from the primary conveyor path. Such document diverter stations may employ a switching roller disposed transverse to the primary conveyor belt and which is movable to push the primary belt in a direction to cause a document to deviate from the primary or main conveyor path to a secondary or branch route. Other diverter stations employ pivotally mounted diverter vanes.

One disadvantage of such sorting and conveying systems, especially those systems adapted to sort and convey non-letter sized mail, including large sized envelopes and magazines, also known as "flats", is that the arrangement of a secondary conveyor belt designed to accept flats diverted from the main document path is often incapable of rapidly processing letter sized mail, which is relatively shorter in length. In such systems, the letter sized mail may become jammed in the belts, disrupting the document sorting process. This disadvantage is especially noticeable when stacks of uniformly dimensioned letter sized mail are to be sorted.

Thus, an object of the present invention is to provide a document sorting apparatus designed to accommodate letter sized mail, as well as flats.

Another object of the present invention is to provide a device for use with a document sorting apparatus which enables the apparatus to be readily converted from sorting uniform stacks of flats to sorting uniform stacks of letter sized mail.

Still another object of the present invention is to provide a device for use with a document sorting apparatus which automatically adapts the apparatus to sort either letter sized mail or flats.

SUMMARY OF THE INVENTION

Accordingly, the above-identified objects are achieved by providing the present pivotal drive stacker roller assembly designed for use with a document sorting and conveying system having a primary document path, a diverter mechanism for diverting documents from the primary path, and at least one secondary document path adapted for receiving documents diverted from the primary path. The present roller assembly includes an idler roller constructed and arranged for controlled, reciprocal movement into and out of engagement with documents in the secondary document path. The roller is placed into engagement with the secondary document path when shorter length documents are being sorted to ensure the advancement of the shorter documents along the secondary path.

More specifically, the present invention provides a secondary pivotal drive stacker roller assembly for a document sorting and conveying apparatus designed to sort documents of various lengths, the roller assembly including a roller oriented for rotation about a vertical axis and for engaging shorter length documents advanced along the secondary document path, a pivot arm for reciprocally pivoting the roller in and out of engagement with documents advanced along the secondary document path, and a control system for controlling the pivot arm to selectively position the roller for engaging the shorter length documents. The present roller assembly is also adapted to disengage the roller from the document path when longer length documents are to be sorted.

If desired, the present roller assembly may be either manually or automatically actuated into and out of engagement with the corresponding document path. If automatic actuation is provided, a document length sensor mechanism may be used to automatically sense the length of documents to be sorted, and to automatically pivot the roller into engagement with the documents in the path if shorter length documents are to be sorted, or out of engagement if longer length documents are to be sorted. It is also contemplated that such a sensing mechanism may be suitable for applications where randomly stacked longer and shorter length documents are to be sorted.

DESCRIPTION OF THE PREFERRED EMBODIMENT

Figure 1:
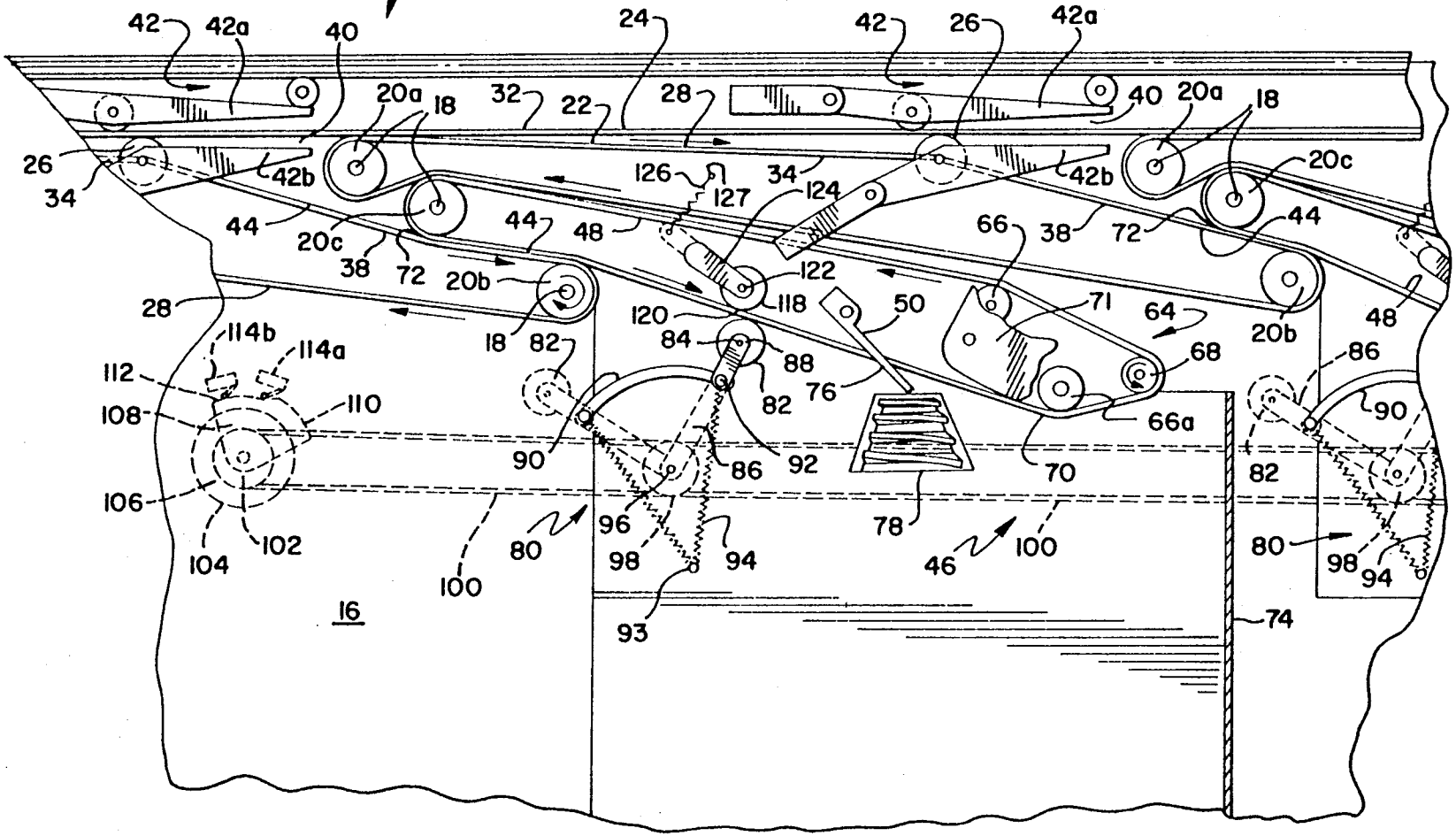
FIG. 1 is a fragmentary plan view of a document conveying apparatus including the secondary pivotal drive stacker roller assembly of the present invention.

Referring now to FIG. 1, a document conveying and sorting system is indicated generally at 10. The document conveying and sorting system 10, which may alternately be designated a document processing system, may form a portion of a larger system for processing documents, such as postal envelopes and letters and the like, and which includes a feeder station 12 (best seen in FIG. 3) from which documents 14 are fed in an on-edge one-at-a-time sequence to a reader station (not shown). The document system 10 is only partially illustrated here, and is disclosed in more detail in corresponding U.S. patent application Ser. No. 676,157 filed Mar. 27, 1991, and titled DIVERTER MECHANISM FOR FLAT DOCUMENT CONVEYOR SYSTEM, which is incorporated by reference herein.

The illustrated document conveying and sorting system 10 represents a portion of one side of a document sorter station having at least one primary document conveying path 22, along which are positioned a plurality of document diverter stations and stacker assemblies. The reader station creates a command signal for each successive document which determines the primary conveying path along which each successive document will travel, and also determines the particular diverter station at which the document will be diverted from the primary document path to a secondary document path and ultimately to a document stacking station having a receiving receptacle.

The document conveying and sorting system 10 includes a support or base plate 16 upon which are mounted a plurality of pivot shafts 18 projecting vertically therefrom. Each shaft 18 has a corresponding roller 20*a–c* mounted for rotation about the shaft. At least one primary document conveying path 22 is defined by an endless primary conveying belt, designated 24, which is trained about a corresponding set of rollers (not shown) which are similar in construction and dimension to the rollers 20*a–d*. The belt 24 is driven by a drive source (not shown), such as a motor, which is preferably located below the support plate 16.

Positioned along the length of the primary conveyor belt 24 is a plurality of secondary conveyor belts, two of which are indicated generally at 28. The position of The secondary conveyor belts 28 defines the entrance to a diverter or sorter station along an outer run 32 of the primary belt 24, and the belts 28 are supported by two rollers, indicated at 20*a* and 20*b*, respectively. The roller 20*a* and a roller 26 of a diverter mechanism 42 define vertical conveyor belt runs 34 for each secondary belt 28 which lie in opposed, partial contacting relation with the corresponding run 32 of the primary document conveying belt 24.

The rollers 20*a* and 20*b* are dimensioned and arranged to be driven at the same longitudinal speed as the primary document conveying belt 24. The rollers 20*b* cooperate with the corresponding rollers 26 to establish a diverter run 38 for each of the secondary conveyor belts 28. Each diverter run 38 is angularly inclined to run 32 of the primary conveyor belt 24. The runs 38 of the secondary conveyor belts 28 are spaced along the run 32 of the primary conveyor belt to create an open span 40 between the inclined run 38 of each secondary conveyor belt and the corresponding run 32 of the primary conveyor belt.

The conveyor system 10 includes a plurality of substantially identical document diverter mechanisms 42 at each of the diverter or sorter stations along the length of the primary conveyor belt 24, such as defined by the secondary conveyor belts 28. It will be understood that a substantially identical document diverter mechanism 42 would be employed with each secondary conveyor belt in the system 10. Each document diverter mechanism 42 includes first and second diverter arms, 42*a* and 42*b* respectively, which are operative in a first position (illustrated in FIG. 1) to guide a non-diverted document along the open span 40 of the primary conveyor belt 24 immediately downstream from the opposed run 34 of the corresponding secondary conveyor belt, such as belt 28.

The first pair of guide arms 42*a* are fixed radially on a vertical support shaft 54 so as to lie above and below, respectively, the upper and lower marginal edges of the primary conveyor belt 24. A sensor mechanism and a time delay circuit (not shown) pivotally operate the shaft 54 to divert documents into the path 44, and to return the arms 42*a* to their normal operating position shortly after the diversion. The second pair of guide arms 42*b* are fixed radially on a vertical support shaft 60 to lie slightly above and below the longitudinal marginal edges of the secondary conveyor belt 28 in similar fashion to the guide arms 42*a*. In their retracted or non-actuated positions, the guide arms 42*b* extend substantially across the open span 40 of the primary conveyor belt run 32 to guide documents across the span.

In addition, the arms 42*a* and 42*b* of each document diverter mechanism 42 are movable to a second position (not shown) operative to divert a document 14 from the primary conveyor path 22 to a corresponding diverter path 44, also referred to as a secondary document path, defined by the inclined run 38 of the corresponding secondary conveyor belt 28. The diverter mechanism 42 then guides the diverted document along the inclined run 38 to a sweeper or stacker station, such as indicated generally at 46. A third conveyor belt 48 and associated kicker arm mechanism, indicated generally at 50, are operatively associated with each secondary conveyor belt 28 to assist in moving a diverted document to the sweeper or stacker station and into a receiving bin or container.

When the reader station "reads" a document and determines that the document is to be diverted from the primary conveyor path, it creates a command signal for the solenoid and sensor system. When a document to be diverted is sensed, the guide arms 42*a* are pivoted to their actuated positions, which effects a movement of both of the opposed runs of the primary and secondary conveyor belts 24, 28 laterally away from their normal positions. This lateral movement of the belts 24, 28 effects a corresponding movement of roller 26 and the guide arms 42*b* to positions wherein the guide arms 42*b* extend generally parallel to the belt run 38. Through the rotation of the guide arms 42*a*, 42*b*, and the movement of the belts 24, 28 a relatively gradual bending is initiated of a diverted document disposed between the opposed belt runs.

As described, a document diverted from the primary conveyor path 22 defined by the primary conveyor belt 24 at any of the diverter or sorter stations, such as defined by the secondary conveyor belt 28, is conveyed to a corresponding stacking assembly, by means of the third conveyor belt 48. The conveyor belt 48 is movably supported on a vertically disposed crowned roller 20*c* at one end, and a roller and drive assembly 64 at the other. The roller and drive assembly 64 includes a pair of idler rollers 66 and 66*a* and a drive roller 68 to establish a run 70 which lies in juxtaposed contacting relation with a portion of the inclined run 38 of the secondary conveyor belt 28 to define diverter path 44. A cover plate 71, shown partially broken away in FIG. 1, overlies roller and drive assembly 64.

As seen in FIG. 1, the roller 20*c* is positioned to the left of roller 20*b*, whereby a portion of third conveyor belt 48 overlies and contacts a portion of run 38 of belt 28. A nip 72 is created between roller 20*c* and belt run 38 which engages and advances a document as the document is diverted along belt run 38 when the diverter 42 is in the actuated position to divert documents into the path 44.

The drive roller 68 of the roller and drive assembly 64 drives the belt 48 at the same speed, and in an opposite rotational direction, than the belt 28. A document being conveyed along the inclined run 38 of the secondary conveyor belt 28 passes between the juxtaposed runs of belts 28 and 48 at path 44 and is carried by belt 48 to a stop position wherein the forward edge of the document engages an upstanding wall 74. If desired, the belt 48 may be driven at a greater speed than the belt 28 in order to provide an accelerating force to the document as it exits the juxtaposed runs of belts 28 and 48.

The kicker arm assembly 50 is provided to prevent the unwanted congestion of multiple documents sorted in rapid succession against the wall 74 and along the run 70, caused by the possibility of the leading edge of one document abutting the trailing edge of a previous document. The kicker arm assembly 50 includes a pair of vertically spaced kicker arms 76. A snap-action movement of the kicker arms 76 effects a corresponding "kicking" of the trailing edge of each document disposed against belt run 70 to move the lower trailing edge of the document laterally away from the belt run 70 sufficiently whereby the lower edge is engaged by a rotating auger 78.

The auger 78 is supported so that a portion of its helical worm surface extends above the upper surface of support plate 16 to receive the lower edge of the document, to push the document away from the belt run 70, and feed the document into the sweeper station 46. In order to assist the action of the auger 78, the idler roller 66*a* is positioned to project the belt 48 toward the sweeper station 46 and act as a fulcrum for sorted documents reaching the wall 74.

It will be appreciated that the distance between the upstanding wall 74 and the roller 20*b*, the point at which the document is released from the path 44 and comes under the control of the kicker arms 76 and the auger 78, is approximately 15½ inches. This distance is designed so that the longest commonly encountered flat document (15 inches long) can be accommodated for placement in the sweeper station 46. One drawback of this arrangement is that shorter, letter sized envelopes and similar documents are not long enough to span the distance between the roller 20*b* and the kicker arms 76, and may fall over before the leading edge engages wall 74.

To address the problem of supporting relatively shorter documents along the belt run 70, the present invention provides a secondary pivotal drive stacker roller assembly, generally designated 80. The purpose of the assembly 80 is to provide an idler roller to selectively support shorter documents traveling along the belt run 70, and which is reciprocally pivotable out of engagement with the documents, and the belt run, when larger documents are being sorted.

The assembly 80 includes an idler roller 82 oriented for rotation about a vertical shaft 84 and dimensioned for engaging shorter length documents advanced along the document path 44 of the sorting apparatus 10. A pivot arm 86 is provided for reciprocally pivoting the roller 82 into and out of engagement with the documents advanced along the document path. The shaft 84 is mounted in a first end 88 of the pivot arm 86.

In the preferred embodiment, the first end 88 of pivot arm 86 projects upward (as viewed in FIG. 1) through an arcuate slot 90 located in the support plate 16 to mount the roller 82 adjacent run 70 of belt 48, while the remainder of the pivot arm 86 is located below the support plate surface 16 and is shown hidden. A vertically projecting lug 92 is positioned on the pivot arm 86 to partially extend through and slide within the slot 90 to define the arcuate limits of the pivoting action of the arm between the two ends of the slot. If desired, the lug may be provided with a protective rubber sleeve (not shown).

A first position of the pivot arm 86 is shown to the right in FIG. 1 and is the position at which the roller 82 is in engagement with the belt run 70 and any documents advanced along the run disposed between belt run 70 and roller 82. A second position of the pivot arm 86 is shown to the left in FIG. 1, and is the position at which the roller 82 is out of engagement with the belt run 70 and is even with or to the left of roller 20*b* to allow the passage of large sized flats to the right of roller 20*b*.

An over center coil spring 94 is connected at one end to the lug 92 beneath support plate 16, and at a second end to the support plate 16 at the pin 93. The biasing action of the spring 94 assists in controlling the movement of the pivot arm 86 between the first and second positions as will be described in further detail in relation to FIGS. 2A–C.

A second end of the pivot arm 86 is attached by means of a pivot shaft 96 to a pulley 98, also located below the surface of the support plate 16. The pulley 98 is connected by a drive belt 100 to a drive pulley 102 connected to a two directional motor 104 through a drive shaft 106, all of which are also preferably located below the support plate 16. A cam 108 is also secured on the drive shaft 106, and has a first, relatively raised lobe 110 at a first radius and a second, relatively lower lobe 112 at a second radius.

Referring now to FIGS. 1 and 2A–C, at least one and preferably two directional switches, designated 114*a* and 114*b*, are each mounted to the underside of support plate 16 so that a contact arm 116 of each switch rides on the lobes 110, 112 of the cam 108. The directional switches 114*a* and 114*b* are disposed in spaced arced relation to each other so that the raised lobe 110 of the rotating cam 108 successively engages and depresses each contact arm 116 to close each of the switches, when the cam rotates in the counterclockwise direction, as viewed in FIGS. 2A–C.

Both switches 114*a* and 114*b* are electrically connected to the motor 104 to control the direction of rotation of the drive shaft 106 in a conventional manner, such as by reversing the motor's polarity, or other known means. In the preferred embodiment, when both switches 114*a*, 114*b* are open and motor 104 is energized, the shaft 106 will rotate counterclockwise, and when both switches are closed when motor 104 is energized, the shaft will rotate clockwise. The rotation of the shaft 106 controls the movement of the pivot arm 86, through the belt 100 and the pulley 98, as seen in FIG. 1.

The spatial placement of the switches 114*a*, 114*b* relative to each other, and the configuration of the lobes 110, 112 on the cam 108, are designed to define a motor drive angle $\alpha$. The size of the angle $\alpha$ is less than the arcuate distance of slot 90, however, angle $\alpha$ represents an amount of rotation of the drive shaft 106 which is sufficient to create enough pivotal displacement of the pivot arm 86 to permit the over center spring 94 to complete the arcuate travel of the arm to either the first or second end positions illustrated in FIG. 1.

Figure 2A:
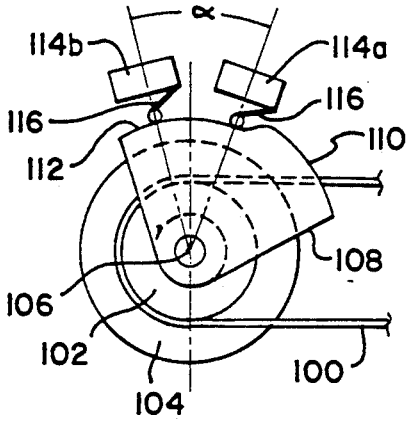
FIG. 2A is a fragmentary plan view of the present drive stacker roller assembly showing the pivot shaft actuating cam with directional switches in the open position.

Referring now to FIG. 2A, the motor 104, the cam 108 and switches 114*a*, 114*b* are shown in the orientation designating the location of the arm 86 in the rightmost or engaged position, shown in FIG. 1. The open position of the contact arms 116 riding upon the lower lobe 112 indicates that upon the next energization of the motor 104, the pivot arm 86 will be driven in the counterclockwise direction to the second or disengaged position, shown to the left in FIG. 1.

Figure 2B:
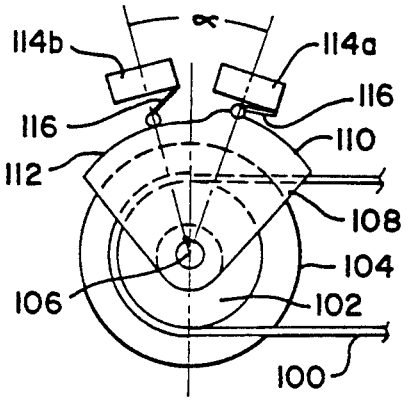
FIG. 2B is a view of the assembly of FIG. 2A shown with one switch in the closed position and the other switch in the open position.

Referring now to FIG. 2B, the components illustrated in FIG. 2A are shown mid-cycle upon energization of the motor 104. This mid-cycle condition will appear identical whether the pivot arm is moving from the engaged position to the disengaged position, or vice versa. It is evident that the contact arm 116 on switch 114*a* has contacted the raised cam lobe 110 and has been closed, while the contact arm on the switch 114*b* remains open and is in contact with the lowered cam lobe 112. In this position, the drive shaft 106 has not completed sufficient rotation to define the angle $\alpha$, and only one of the switches 114*a*, 114*b* has been actuated, so the rotative direction of the motor will not change.

Figure 2C:
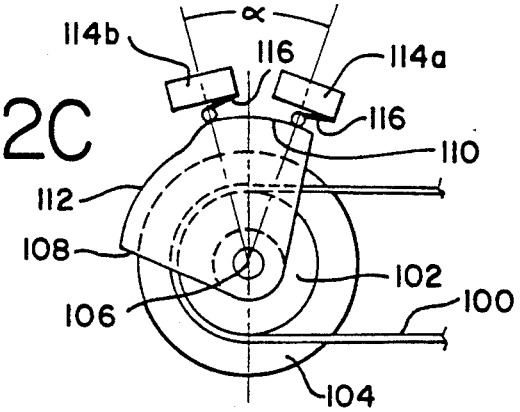
FIG. 2C is a view of the assembly of FIG. 2B shown with both directional switches in the closed position.

Referring now to FIG. 2C, the same components depicted in FIGS. 2A and 2B are shown in the opposite cyclical position to that depicted in FIG. 2A. In FIG. 2C, the contact arms 116 of both switches 114*a* and 114*b* are in contact with the raised cam lobe 110, and have been closed. The closing of both switches will change the rotative direction of the motor 104 upon its next energization to be opposite that of the position depicted in FIG. 2A. In the preferred embodiment, when both switches are open, counterclockwise rotation is triggered, while the closure of both switches triggers clockwise rotation. It is contemplated that the direction of rotation in each position may be changed to suit the application.

Thus, it will be seen that energization of the motor 104 sufficient to cause the movement of the pivot arm 86 from the first, or engaged position, to the second, or disengaged position will, through the action of the cam 108 and the switches 114*a*, 114*b*, change the operational direction of the motor 104 so that upon the next energization of the motor, the pivot arm will be moved in the opposite direction. In this manner, a simple electric motor may be employed, instead of a relatively expensive stepping motor, to drive pivot arm 86 and roller 82. Also, the motor 104 need only be rotated a sufficient amount to permit the biasing action of the off center spring 94 to complete the movement of the pivot arm 86.

Referring now to FIG. 1, it will be seen that the document conveying system 10 includes a back up roller 118 positioned to create a nip 120 between the roller 118 and the roller 82, with the belt 48 held therebetween. The roller 118 is rotatable about a vertically oriented shaft 122 which in turn is fixed to an end of a pivot arm 124. A spring 126 connected to an opposite end of the pivot arm 124 biases the roller 118 against the roller 82 and the belt 48 to add support for documents passing through nip 120. The spring 126 is anchored to the underside of support plate 16 at pin 127. A portion of the pivot arm 124 is shown located below the support plate 16.

The document feeder system 10 is only partially illustrated in FIG. 1, and preferably includes a plurality of diverters 42 and sweeper stacker stations 46, as well as a like plurality of pivotal drive stacker roller assemblies 80 and related components. In order to maximize efficiency, a single motor 104 is preferably employed, and multiple pulleys 98 are provided, each with a corresponding pivot arm 86 and roller 82. The multiple pulleys 98 are connected to each other by a series of drive belts 100. Thus, one motor 104, acting through the drive pulleys 98 and drive belts 100, may simultaneously operate to drive a plurality of rollers 82 from the first or engaged position to the second or disengaged position.

Figure 3:
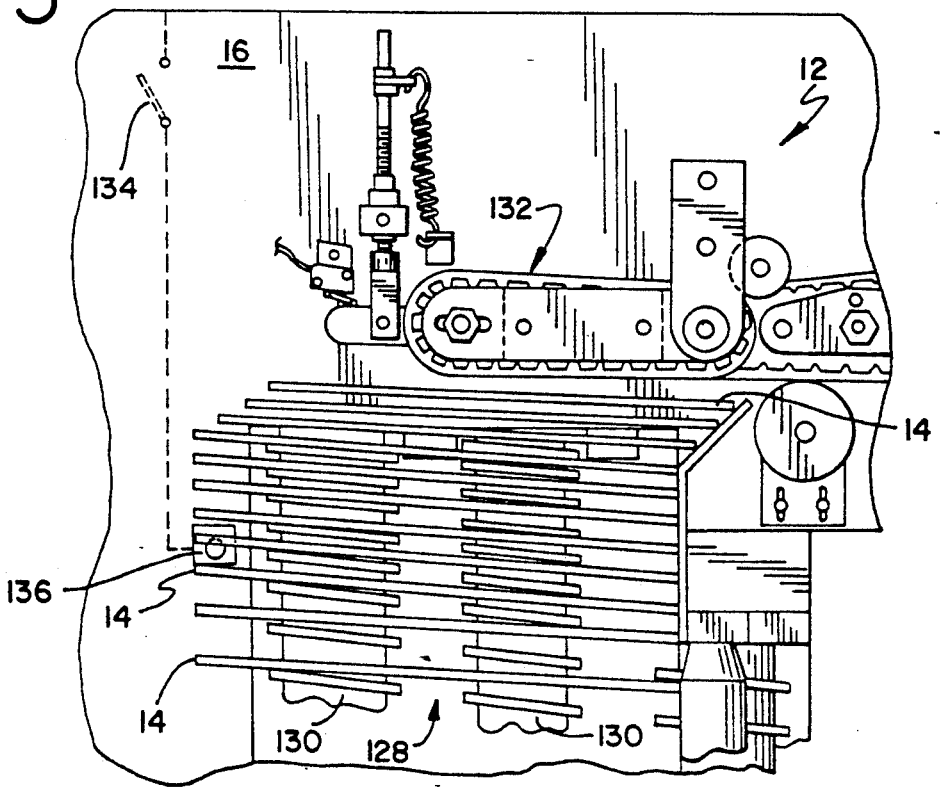
FIG. 3 is a fragmentary plan view of a document feeder magazine suitable for use with the document conveying apparatus depicted in FIG. 1.

Referring now to FIG. 3, the feeder station 12 is partially depicted in plan view. Feeders of this general type are known, and basically include a document conveyor mechanism 128 including a pair of augers 130 which carry the documents 14 in generally on edge, parallel orientation toward a document feeder 132. The feeder 132 accepts the documents 14 and advances them sequentially to the right in FIG. 3, toward downstream processing and sorting equipment, such as the diverters 42 and sweeper stacker stations 46.

In the preferred embodiment, a switch 134 is provided to control the energization of the motor 104, and the consequential pivoting motion of the pivot arms 86 and roller 82 between the first and second positions. The switch 134 may be manually actuated, for applications when the operator decides to sort either letter sized mail or flats, exclusively. In some cases, however, the supply of documents 14 to be sorted may include both flats and letter sized documents, in a somewhat or totally random orientation. An automatic system for properly positioning the roller 82 is thus called for.

Accordingly, a document length sensor 136, such as a photocell, is positioned in the support plate 16 near the augers 130. The sensor 136 is specifically positioned relative to the augers 130 so that only flats having a longer length will be sensed by the sensor. The sensor 136 is electrically connected to the switch 134 to send a signal to the OCR or bar code reader in the document path after singulation of the documents by feeder 132 to instruct the reader as it selects a stacker station for a particular document whether that document has a long or short horizontal length. As the stacker station is selected, a signal is also sent to energize the motor 104 associated with the selected stacker station, which actuates the pivot arm 86 so that the selected pivot arm is moved to the disengaged position by the time the longer length flats reach the belt run 70.

It is contemplated that an electrical time delay circuit (not shown) may be employed to accommodate the delay between the triggering of the switch 134 by the sensor 136 and the arrival of the documents 14 along the belt run 70. Once letter sized envelopes are conveyed by the augers 130, the sensor 136 is no longer tripped, and the switch 134 is allowed to open, which will permit the motor 104 to move the pivot arm 86 to the engaged position.

The sensor 136 and the switch 134 are capable of switching all of the pivot arms 86 controlled by each motor 104. One such motor, connected to five pivot arms 86, is contemplated for every five sorting stations 46 of the document sorting and conveying system 10. Thus, blocks of documents 14 of the same length can be automatically sorted using the sensor 136. However, if totally randomly mixed stacks of letter sized and flat mail are to be sorted, each pivot arm 86 must be operated by an individual motor 104 or other independently operated system, and the sensor 136 is preferably connected to the document reader as mentioned previously so that a specific pivot arm 86 is placed into the appropriate position depending on the length of the document.

While a particular embodiment of the secondary pivotal drive stacker roller enabling stacking of small and large documents of the invention has been shown and described, it will be appreciated by those skilled in the art that changes and modifications may be made thereto without departing from the invention in its broader aspects and as set forth in the following claims.

What is claimed is:

1. A secondary pivotal drive stacker roller assembly for a document sorting and conveying apparatus adapted for advancing and sorting documents of various lengths, said roller assembly comprising:

a roller oriented for rotation about a vertical axis and adapted for engaging shorter length documents advanced along a document path of the sorting apparatus;

pivot means for reciprocally pivoting said roller into and out of engagement with the documents advanced along the document path, said pivot means including a pivot arm having a first end configured for accommodating said roller and a second end connected to a pivot shaft;

drive means for selectively and reciprocally rotating said pivot means between a first position wherein said roller engages the shorter length documents, and a second position wherein said roller is disengaged from the documents; and control means for controlling said drive means to selectively position said roller for engaging the shorter length documents, said control means including a rotatable cam, means for causing said cam to rotate in response to the pivoting of said pivot shaft, and at least one directional switch arranged to be actuated by rotation of said cam.

2. The roller assembly as defined in claim 1 wherein said pivot means further includes biasing means for assisting the pivoting action of said pivot means between said first position and said second position.

3. The roller assembly as defined in claim 2 wherein said biasing means is an over center spring.

4. The roller assembly as defined in claim 1 wherein said drive means is configured for rotating multiple pivot arms of multiple roller assemblies.

5. The roller assembly as defined in claim 4 wherein said drive means includes a single motor connected to said multiple pivot arms by a belt and pulley system.

6. The roller assembly as defined in claim 1 wherein said control means further includes a switch connected to said drive means for causing the pivoting action of said roller into and out of engagement with the documents.

7. The roller assembly as defined in claim 1 including a pair of said switches being electrically connected to said drive means for controlling the direction of rotation of said pivot arm between said first position and said second position, said switches being connected to each other and to said drive means so that the rotation of said arm from said first position to said second position actuates said switches, which then change the direction of said drive means to reverse the pivotal action of said pivot arm when said drive means are energized, so that upon energization of said drive means, said pivot arm pivots between said second position and said first position.

8. The roller assembly as defined in claim 7 wherein when said switches are both in a closed position, said drive means rotates said pivot arm clockwise, and when both said switches are in an open position, said drive shaft rotates said pivot arm counterclockwise.

9. The roller assembly as defined in claim 1 wherein said control means further includes sensing means for sensing the length of documents being sorted and conveyed by the apparatus, said sensing means being connected to said drive means for manipulating said roller in accordance with the sensed length of documents to be sorted.

10. A secondary pivotal drive stacker roller assembly for a document sorting and conveying apparatus adapted for advancing and sorting documents of various lengths, said roller assembly comprising:

a roller oriented for rotation about a vertical axis and adapted for engaging shorter length documents advanced along a document path of the sorting apparatus;

pivot means for reciprocally pivoting said roller into and out of engagement with the documents advanced along the document path;

control means including at least one directional switch for controlling said pivot means to selectively position said roller for engaging the shorter length documents; and sensing means for sensing the length of the documents being sorted and conveyed by the apparatus, said sensing means being connected to said pivot means for manipulating said roller in accordance with the sensed length of the documents to be sorted.

11. The roller assembly as defined in claim 10 wherein said pivot means includes a pivot arm having a first end configured for accommodating said roller and a second end connected to a pivot shaft, said roller assembly further including a pair of said directional switches being electrically connected to drive means for controlling the direction of rotation of said pivot arm between said first position and said second position, said switches being connected to each other and to said drive means so that the rotation of said arm from said first position to said second position actuates said switches, which then change the direction of said drive means to reverse the pivotal action of said pivot arm when said drive means are energized, so that upon energization of said drive means, said pivot arm pivots between said second position and said first position.

12. The roller assembly as defined in claim 10 wherein said control means further includes camming means secured to said pivot means for actuating said at least one directional switch.

13. In a conveyor system for conveying generally flat documents on-edge, said system including a primary conveyor means defining a primary document path, means for diverting documents from said primary document path, and at least one secondary conveyor means defining a secondary document path arranged to receive documents diverted from said primary document path, a secondary pivotal drive stacker roller assembly disposed in operational relationship to each said secondary document path and comprising:

a roller oriented for rotation about a vertical axis adapted and for engaging shorter length documents advanced along each of said secondary document paths;

pivot means for reciprocally pivoting said roller into and out of engagement with the documents advanced along said secondary document path; and control means for controlling said pivot means to selectively position said roller for engaging the shorter length documents.

14. The roller assembly as defined in claim 13 wherein said pivot means includes a pivot arm having a first end configured for accommodating said roller, and a second end connected to a pivot shaft.

15. The roller assembly as defined in claim 14 further including drive means for selectively and reciprocally rotating said pivot shaft between a first position wherein said roller is engaged with the documents, and a second position wherein said roller is disengaged from the documents.

16. The roller assembly as defined in claim 15 wherein said secondary conveyor means includes a plurality of secondary belts, each defining a secondary document path, each said secondary document path having a corresponding roller assembly and pivot arm, said drive means including a single motor operating the pivoting action of all said pivot arms.

17. The roller assembly as defined in claim 13 wherein said control means further includes sensing means for sensing the length of documents being sorted and conveyed by the apparatus, said sensing means being connected to said drive means for manipulating said roller in accordance with the sensed length of documents to be sorted.

18. The roller assembly as defined in claim 13 wherein said pivot means further includes biasing means for assisting the pivoting action of said pivot arm between said first position and said second position.

19. The roller assembly as defined in claim 18 wherein said biasing means is an over center spring.

* * * * *